United States Patent [19]

Hernqvist et al.

[11] 4,361,370

[45] Nov. 30, 1982

[54] APPARATUS AND METHOD FOR CLEANING SHADOW MASKS IN COLOR PICTURE TUBES

[75] Inventors: Karl G. Hernqvist, Princeton; Donald C. Pultorak, Trenton, both of N.J.

[73] Assignee: RCA Corporation, New York, N.Y.

[21] Appl. No.: 192,365

[22] Filed: Sep. 30, 1980

[51] Int. Cl.[3] ..... H01J 9/00

[52] U.S. Cl. ..... 316/2; 313/402; 313/323; 316/28

[58] Field of Search ..... 316/2, 28; 313/402, 313/407, 404, 323; 134/8; 15/104.05, 104 R

[56] References Cited

U.S. PATENT DOCUMENTS

| | | | |
|---|---|---|---|
| 261,234 | 7/1882 | Jameson | 316/28 |
| 2,667,600 | 1/1954 | Goff | 313/152 X |
| 3,912,564 | 10/1975 | Rogers | 313/402 X |
| 3,979,633 | 9/1976 | Davis et al. | 313/407 X |

OTHER PUBLICATIONS

*Technical Notes No. 1254* A publication of RCA, Princeton, N.J. Sep. 3, 1980.

*Primary Examiner*—Kenneth J. Ramsey

*Attorney, Agent, or Firm*—Eugene M. Whitacre; Dennis H. Irlbeck

[57] ABSTRACT

The present invention provides an improvement in shadow mask type color picture tubes. The improvement comprises a ferromagnetic member located within a tube and means for holding the ferromagnetic member within the tube. The invention also encompasses a method of utilizing the ferromagnetic member to remove particles from a shadow mask of a color picture tube. The method includes the use of a magnet to release the ferromagnetic member from the holding means and to move the ferromagnetic member over a surface of the shadow mask.

6 Claims, 5 Drawing Figures

APPARATUS AND METHOD FOR CLEANING SHADOW MASKS IN COLOR PICTURE TUBES

This invention relates generally to shadow mask type color picture tubes and particularly to an apparatus and method for clearing blocked shadow mask apertures in a completed color picture tube.

During the manufacturing of color picture tubes, small particles may accidentally land on the gun side of a shadow mask. Such particles will result in picture defects which will cause the tube to be rejected. The particles are of two kinds, conductive and nonconductive. Conductive particles cause picture defects only when actually blocking a shadow mask aperture. The conductive particles can often be removed by heating using the electron beams from the electron gun within the tube. Not only do nonconductive particles block apertures, but the nonconductive particles also may become negatively charged by the impact of the electron beams. Such charging has three effects. First, a charged particle may cause a slight deflection of an electron beam thus causing the beam to misregister with its corresponding phosphor element. This misregister will create a picture defect even though the charged particle does not block a shadow mask aperture. Second, since a charged particle repells an electron beam, it cannot be removed by electron beam heating as can be done with nonconductive particles. Third, because of the charge on the particle, electrostatic attraction will hold it to the metal mask.

Since the charged particles are in a vacuum in a completed tube, some of the charge will remain on the particles indefinitely. The removal of these charged particles from a shadow mask requires two steps. First, discharging of the particles and second, mechanical dislodging of the particles. A problem then exists of how to perform these two steps in a completed tube. The present invention solves this problem in a novel manner.

SUMMARY OF THE INVENTION

The present invention provides an improvement in shadow mask type color picture tubes. The improvement comprises a ferromagnetic member located within a tube and means for holding the ferromagnetic member within the tube. The invention also encompasses a method of utilizing the ferromagnetic member to remove particles from a shadow mask of a color picture tube. The method includes the use of a magnet to release the ferromagnetic member from the holding means and to move the ferromagnetic member over a surface of the shadow mask.

DETAILED DESCRIPTION OF THE PREFERRED EMBODIMENT

Figure 1:
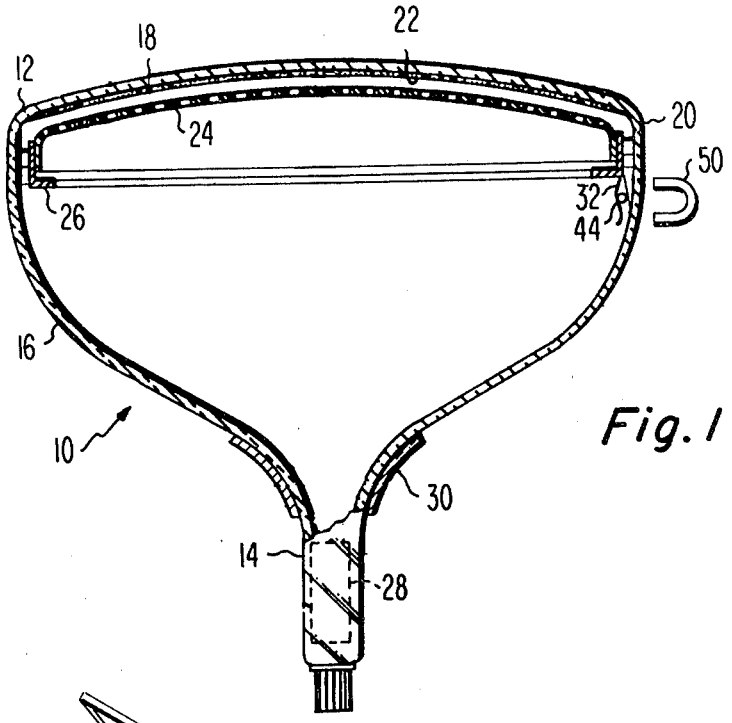
FIG. 1 is a sectional side view of a shadow mask type color picture tube incorporating a preferred embodiment of the present invention.

FIG. 1 is a sectional side view of a rectangular color picture tube 10 having a glass envelope comprising a rectangular faceplate panel, or cap, 12 and a tubular neck 14 connected by a rectangular funnel 16. The panel comprises a viewing faceplate 18 and peripheral flange, or sidewall, 20 which is sealed to the funnel 16. A mosaic three-color phosphor screen 22 is carried by the inner surface of the faceplate 18. The screen is preferably a line screen with the phosphor lines extending substantially perpendicular to the high frequency raster line scan of the tube (normal to the plane of FIG. 1). A multi-apertured color selection electrode, or shadow mask, 24 is attached to a peripheral L-shaped frame 26 which is removably mounted, by conventional means, in predetermined spaced relation to the screen 22. An electron gun 28, shown schematically by dotted lines in FIG. 1, is centrally mounted within the neck 14 to generate and direct three electron beams along coplanar convergent paths through the mask 24 to the screen 22.

The tube of FIG. 1 is designed to be used with an external magnetic deflection yoke, such as the yoke 30 schematically shown surrounding the neck 14 and funnel 12 in the neighborhood of their junction. When activated, the yoke 30 subjects the three beams to vertical and horizontal magnetic flux, which cause the beams to scan horizontally and vertically, respectively, in a rectangular raster over the screen 22.

Figure 2:
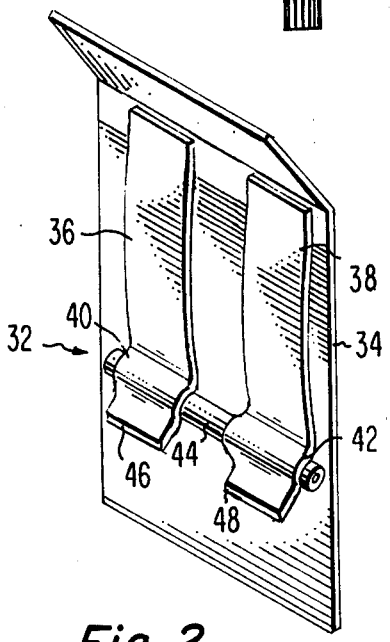
FIG. 2 is a perspective view of the spring assembly shown in FIG. 1.

Also shown in FIG. 1 is a spring assembly 32 attached to a lower flange of the L-shaped frame 26. The spring assembly 32, shown in greater detail in FIG. 2, includes a bracket 34 that extends from the frame 26 to the wall of the funnel 16. Two spaced leaf springs 36 and 38 are attached welded to the bracket 34 near the end of the bracket 34 that is attached to the frame 26. The other ends of the springs 36 and 38 include detents 40 and 42, respectively, to hold a lightweight cylindrical ferromagnetic member 44 against the bracket 34. The distal ends 46 and 48 of the springs 36 and 38, respectively, are curved away from the bracket 34 to permit the easy insertion of the ferromagnetic member 44 under the springs 36 and 38. Preferably, the spring assembly 32 is constructed of a nonmagnetic material, such as stainless steel. A permanent magnet 50 is shown external to the tube 10. The function of this magnet 50 is discussed with respect to the novel method of cleaning the shadow mask 24 using the ferromagnetic member 44.

In the preferred embodiment, the ferromagnetic member 44 is a cylinder approximately one inch (2.54 cm) long and one-eight (0.32 cm) in outer diameter. A preferred material for the cylinder 44 is an iron-nickel-cobalt alloy such as manufactured under the Westinghouse trademark Kovar.

Figure 3:
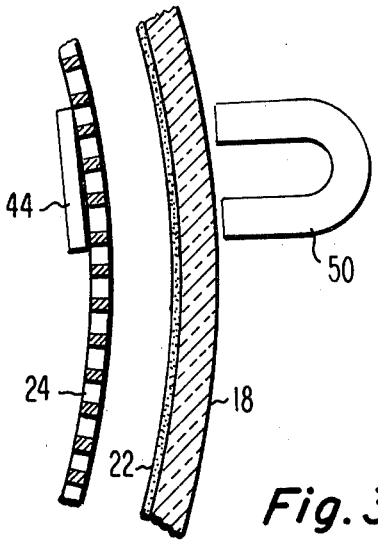
FIG. 3 is a sectional side view of a portion of a faceplate and shadow mask showing a cylinder being controlled by an external magnet.

The first step in the novel mask cleaning method is to turn the tube 10 so that the faceplate 18 is facing down. Now, the magnet 50 is brought close to the ferromagnetic member or cylinder 44 and moved upward to free the cylinder 44 from springs 36 and 38. Next, the magnet 50 is moved away from the cylinder 44 and the cylinder is permitted to drop onto the shadow mask 24. Thereafter, the cylinder 44 is captured by the magnet 50 by bringing the magnet against the tube faceplate 18, as shown in FIG. 3. Thereafter, the tube 10 is rotated so that the faceplate 18 faces sideways. The magnet 50 now is moved around until the cylinder 44 has removed the particle or particles from the shadow mask 24. Following completion of the mask cleaning process, the magnet 50 is removed from the vicinity of the cylinder 44 permitting the cylinder 44 to drop onto the funnel 16. Now, the cylinder 44 again is captured by bringing the magnet 50 near it. Finally, the magnet 50 is moved to place the cylinder 44 under the springs 36 and 38.

Figure 4:
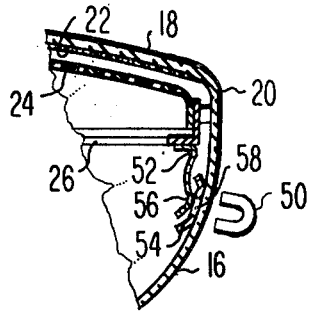
FIG. 4 is a sectional side view of a portion of a shadow mask type color picture tube incorporating another embodiment of the present invention.
Figure 5:
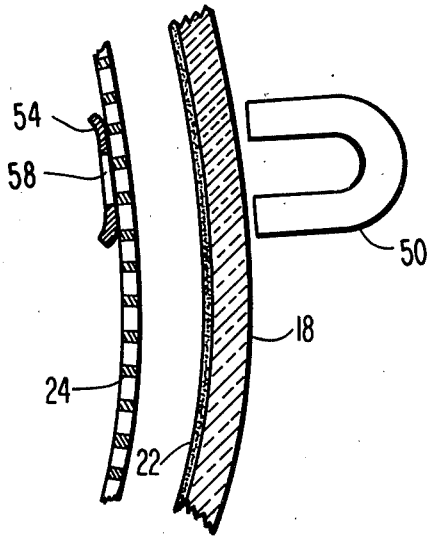
FIG. 5 is a sectional side view of a portion of a faceplate and shadow mask showing a disc being controlled by an external magnet.

An alternate embodiment of an apparatus for cleaning shadow masks is shown in FIGS. 4 and 5. In this embodiment, a spring 52, preferably nonmagnetic, is attached to a lower flange of the L-shaped frame 26. The spring 52 extends from the frame 26 to the wall of the funnel 16 with the distal end of the spring 52 bending away from the funnel wall toward the center of the tube. A ferromagnetic washer-shaped disc 54 is shown located between the spring 52, and the wall of the funnel 16. The peripheral edge of the disc 54 is curved slight out of the plane of the disc 54. The spring 52 has a detent 56 in it which rests in a recess or hole 58 in the disc 54. The spring 52 exerts a force toward the funnel wall thereby holding the disc 54 securely in place. The method for using the disc 54 to clean the shadow mask 24 is the same as that described with respect to the cylinder 44.

What is claimed is:

1. In a shadow mask type color picture tube, the improvement comprising means for cleaning said shadow mask including a ferromagnetic member located within the tube and means for releasably holding said ferromagnetic member in a storage portion within the tube.

2. The tube as defined in claim 1 wherein said ferromagnetic member is a cylinder.

3. The tube as defined in claim 1 wherein said ferromagnetic member is a disc with a recess therein.

4. The tube as defined in claim 1 wherein said means for releasably holding includes at least one spring.

5. In a shadow mask type color picture tube, the improvement comprising means for cleaning said shadow mask including a ferromagnetic cylinder located within the tube and at least one spring for holding the cylinder in a storage position within the tube.

6. A method for cleaning particles from a shadow mask of a completed color picture tube comprising the steps of removing a ferromagnetic member from a holding means located within the completed color picture tube by moving a magnet external to the tube, relocating the ferromagnetic member to the shadow mask, moving the ferromagnetic member over a surface of the shadow mask by moving the magnet external to the tube, and replacing the ferromagnetic member in the holding means by moving the magnet external to the tube.

* * * * *

UNITED STATES PATENT AND TRADEMARK OFFICE

CERTIFICATE OF CORRECTION

PATENT NO. : 4,361,370

DATED : 11/30/82

INVENTOR(S) : Karl G. Hernqvist et al.

It is certified that error appears in the above-identified patent and that said Letters Patent is hereby corrected as shown below:

Claim 1, Column 4, Line 2 - "portion" should read

-- position -- .

Signed and Sealed this

*Fifth* Day of *April 1983*

[SEAL]

*Attest:*

GERALD J. MOSSINGHOFF

*Attesting Officer*

*Commissioner of Patents and Trademarks*